US006308338B1

(12) United States Patent
Caldwell

(10) Patent No.: US 6,308,338 B1
(45) Date of Patent: Oct. 30, 2001

(54) TROUSER SUSPENDERS

(76) Inventor: Alphonso Harold Caldwell, 414 Giggle Dr., Laurens, SC (US) 29360

( * ) Notice: Subject to any disclaimer, the term of this patent is extended or adjusted under 35 U.S.C. 154(b) by 0 days.

(21) Appl. No.: 09/638,635

(22) Filed: Aug. 14, 2000

(51) Int. Cl.[7] ..... A41F 9/00
(52) U.S. Cl. ..... 2/312; 2/315
(58) Field of Search ..... 2/311–314, 303, 2/304, 326, 338, 227, 240, 77, 115, 79, 300, 315, 230

(56) References Cited

U.S. PATENT DOCUMENTS

| | | | | |
|---|---|---|---|---|
| 2,567,277 | * | 9/1951 | Farquhar | 2/313 |
| 2,638,594 | * | 5/1953 | Brent et al. | 2/26 |
| 3,932,897 | * | 1/1976 | Young | 2/306 |
| 4,285,069 | | 8/1981 | Hall . | |
| 4,850,057 | | 7/1989 | Schierenbeck . | |
| 5,027,441 | * | 7/1991 | Wilson | 2/240 |
| 5,036,549 | | 8/1991 | Jackson . | |
| 5,214,806 | * | 6/1993 | Flores | 2/312 |
| 5,623,735 | | 4/1997 | Perry . | |
| 5,682,619 | | 11/1997 | Griffin . | |
| 5,689,832 | | 11/1997 | Head . | |
| 5,774,899 | | 7/1998 | Griffin . | |
| 5,867,836 | | 2/1999 | Quinones . | |
| 6,026,516 | | 2/2000 | Dacyshyn . | |

* cited by examiner

*Primary Examiner*—John J. Calvert
*Assistant Examiner*—Tejash Patel
(74) *Attorney, Agent, or Firm*—Joseph T. Guy; Hardaway/Mann IP Group

(57) ABSTRACT

Trouser suspenders for securing trousers in a predetermined position below the waist. The trouser suspenders have a waist strap designed to extend around the waist of a wearer. A first extender is attached to, and dependent from, the waist strap and the first extender has one fastener attached directly thereto. A second extender is attached to, and dependent from, the waist strap and the second extender has one fastener attached directly thereto. The fastener of the first extender and the fastener of the second extender attach to the trousers.

17 Claims, 2 Drawing Sheets

TROUSER SUSPENDERS

FIELD

The present invention is related to the field of clothing and more particularly to suspenders which are worn around the waist and which maintain trousers at a predetermined height below the waist.

BACKGROUND

Trousers are typically worn with the waistband roughly corresponding to the waist of the person wearing the trousers. The trousers are typically maintained in this position by a belt received within belt loops, which are integrated into the waistband of the trousers, or with suspenders which reach over the shoulders or around the neck and grasp the trousers at or near the waistband. Examples of suspenders are provided in U.S. Pat. Nos. 6,026,516; 5,774,899; 5,682,619; 5,623,735; 5,036,549 and 4,850,057.

In a more recent development it has become common for trousers to be worn which are to large in the waist and therefore sag, or drop, substantially below the waist of the person wearing the trousers. Due to the excessive size of the trousers worn they tend to drop so low as to be a nuisance for the wearer due to the requirement that one hand to be allocated to maintaining the trousers in a position which prohibits them from falling well below the intended level. In some cases a belt is worn but the trousers are typically at or below the widest portion of the hips and therefore a belt must be uncomfortably tight to maintain the trousers in a reasonable position or the trousers must be pulled up to their standard position which defeats the purpose of wearing the trousers below the waist. Suspenders are not considered acceptable due to the weight of the suspenders on the shoulders and the fact that when sitting the excess suspender material tends to bunch and become unsightly. Sagging double bottom pants have been described in, for example, U.S. Pat. No. 5,689,832 but these have not been acceptable due, in part, to the excess material which causes the pants to be warmer and the lack of acceptability as a fashion.

U.S. Pat. No. 4,285,069 describes a garter for maintaining socks in an up right position. Pants typically fall down in the rear first and therefore the device described in U.S. Pat. No. 4,285,069 would be insufficient to work for securing pants.

There has been a desire in the art for an apparatus, and method, for supporting trousers below the waist while not creating an unsightly appearance exceeding that of the trousers and visible undergarments.

SUMMARY

It is an object of the invention to provide suspenders for maintaining trousers in a predetermined position below the waist.

It is another object to provide suspenders for maintaining trousers in a predetermined position which does not place weight on the shoulders or back of the neck and which will not bunch up when seated.

It is yet another object to provide suspenders for maintaining trousers in a predetermined position which will not be unsightly.

A particular feature is the ability to incorporate the suspenders into undergarments which does not require an increase in the articles of clothing being worn and which increases the functionality of the undergarment These and other advantages, as will be apparent from the descriptions herein, are provided in trouser suspenders for securing trousers in a predetermined position below the waist. The trouser suspenders comprise a waist strap designed to extend around the waist of a wearer. A first extender is attached to, and dependent from, the waist strap and the first extender has one fastener attached directly thereto. A second extender is attached to, and dependent from, the waist strap and the second extender has one fastener attached directly thereto. The fastener of the first extender and the fastener of the second extender attach to the trousers.

Another embodiment is provided in a method for securing trousers at a predetermined height below the waist comprising the steps of:

a) wearing a trouser suspender wherein the trouser suspender comprises a waist strap designed to extend around the waist of a wearer; and at least one extender is attached to the waist strap, and dependent from, the waist strap wherein the extender comprises a fastener, and b) attaching the trouser suspender to the trousers with the fastener.

Yet another embodiment is provided in trouser suspenders for securing trousers in a predetermined position below the waist. The trouser suspenders comprise an undergarment wherein the undergarment comprises a modesty panel and a waist band. At least one extender is attached to the undergarment. A fastener is attached to the extender wherein the fastener attaches to the trousers which are worn over the undergarment.

DETAILED DESCRIPTION

The trouser suspenders will be described with reference to the figures wherein similar elements are numbered accordingly.

Figure 1:
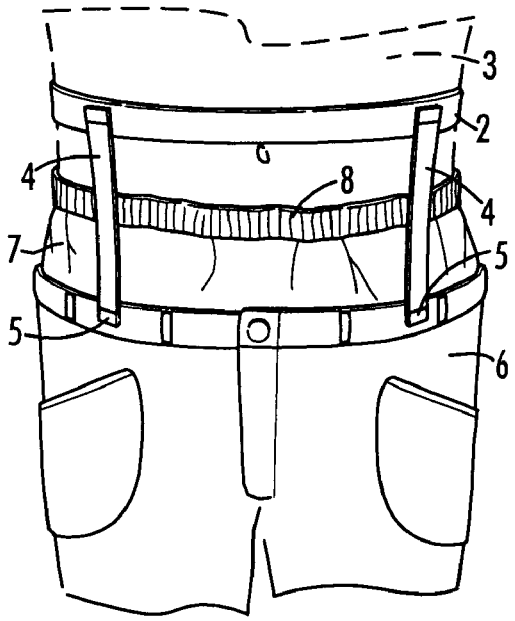
FIG. 1 is a view of the trouser suspenders of the present invention as used.

Referring to FIG. 1, the trouser suspenders, generally represented at 1, comprise a waist strap, 2, which circumvents the wearer, 3, at or near the waist. Attached to the waist strap, 2, and extending downward are at least two extenders, 4, which extend downward from the waist strap. At the lower end of each extender is a fastener, 5, which reversibly attaches to the trousers, 6. In use an undergarment is typically worn under the trousers. The undergarment comprises a modesty panel, 7, which covers the private parts of the wearer, and an undergarment waistband, 8, which elastically secures the undergarment and maintains the undergarment in position. The modesty panel typically comprises cylindrical appendages which form legs and which the wearer inserts their legs into as is common with undergarments and particularly boxer shorts.

In use, the wearer, 3, places the waist strap, 2, around the waist by stepping through the stretched waist strap. The trousers, 6, are then pulled upward to the appropriate height and attached to the fasteners, 5.

Figure 2:
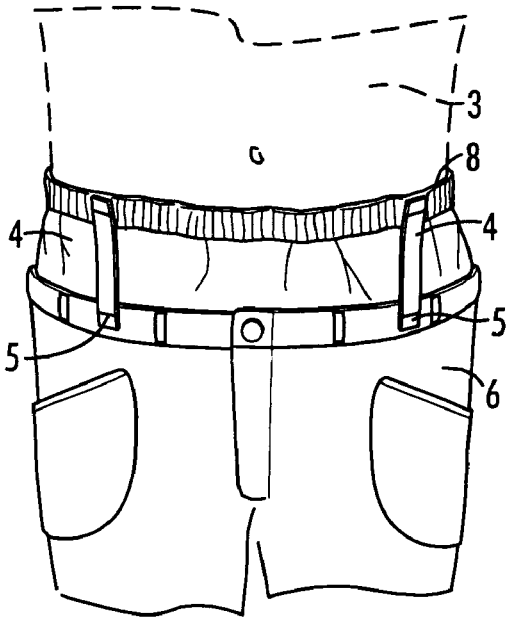
FIG. 2 is a view of an alternate embodiment of the present invention as used.

An alternate embodiment of the trouser suspenders is described in reference to FIG. 2. In FIG. 2, the extenders, 4, are attached to the undergarment preferably at the undergarment waistband, 8. In this embodiment the undergarment waistband forms the waist strap for the trouser suspenders. Fasteners, 5, attached to the lower end of the extenders attach to the trousers, 6, as previously described.

In use, the wearer, 3, puts on the undergarment as normally done. The trousers are then pulled to the appropriate height and attached to the fasteners, 5.

Figure 3:
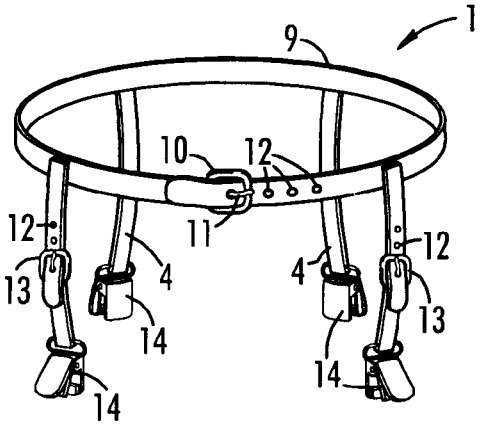
FIG. 3 is a view of an embodiment of the present invention wherein the extenders and waist strap are adjustable.

Another alternate embodiment of the trouser suspenders is described in reference to FIG. 3. In FIG. 3, the trouser suspenders, 1, comprise an adjustable waist strap, 9. The adjustable waist strap comprises a buckle, 10, and post, 11. The post, 11, is received in the appropriate void, 12, of the adjustable waist strap, 9, and the length of the adjustable waist strap is fixed by contact of the post, 11, with the buckle, 10. The embodiment illustrated in FIG. 3 further comprises adjustable extenders, 12, which are adjustable with a buckle and post arrangement, 13. Suspender fasteners, 14, attached to the adjustable extenders, 12, and extenders, 4, attach to trousers which are not shown.

Figure 4:
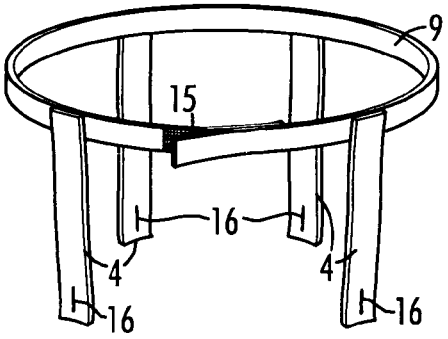
FIG. 4 is a view of an embodiment of the present invention wherein the waist strap is adjustable and the fasteners are button slots.

Another alternate embodiment of the trouser suspenders is described in reference to FIG. 4. an In FIG. 4, the trouser suspenders, 1, comprise an adjustable waist strap, 9, wherein the adjustable waist strap comprises a hook-pile connector, 15, such as Velcro® or a similar connector. The extenders, 4, comprise button slots, 16, which receive buttons secured to the trousers.

Figure 5:
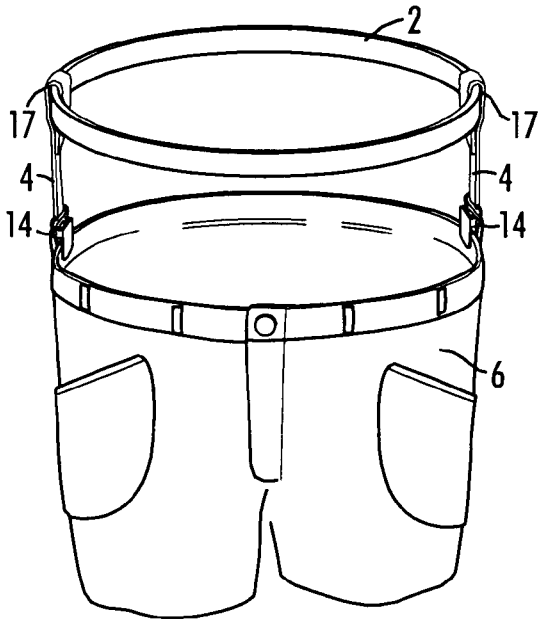
FIG. 5 is a view of an embodiment of the present invention wherein the extenders are arranged opposite to each other.

Another alternate embodiment of the trouser suspenders is described in reference to FIG. 5. In FIG. 5, the trouser suspenders, 1, comprises a waist strap, 2, with two extenders, 4, attached thereto. The two extenders are positioned opposite to each other such that, in use, one extender is at each side of the wearer. The waist strap, 2, is received within a loop, 17, of the extenders, 4. Suspender fasteners, 14, are reversibly attached to the trousers, 6, which are shown in partial side view.

In the present description the waist is described as the portion of the body just above the hips or widest portion of the body.

The waist band may be manufactured from stretchable material which is well known in the art. It is preferred that the waist band be stretchable, or adjustable, but it is not considered necessary for the waist band to be both stretchable and adjustable even though this would be considered within the metes and bounds of the invention.

The extenders may be manufactured from a stretchable material if so desired but this is not necessary and a non-stretchable material has been demonstrated to be acceptable and is preferred due to the lower cost.

The invention has been described with special attention drawn to the preferred embodiments. These are intended to demonstrate the use of the invention and do not limit the scope of the invention which is set forth in the claims which follow.

What is claimed is:

1. Trouser suspenders for securing trousers in a predetermined position below the waist wherein said trouser suspenders comprise:

a waist strap designed to extend around the waist of a wearer;

a first extender attached to, and dependent from, said waist strap wherein said first extender has one fastener attached directly thereto at a lower end of said extender; and a second extender attached to, and dependent from, said waist strap wherein said second extender has one fastener attached directly thereto at a lower end of said second extender; and wherein said fastener of said first extender and said fastener of said second extender attach to said trousers and maintain said trousers in a predetermined position below the waist.

2. The trouser suspenders of claim 1 wherein said waist strap is an adjustable waist strap.

3. The trouser suspenders of claim 2 wherein said adjustable waist strap further comprises a buckle.

4. The trouser suspenders of claim 2 wherein said adjustable waist strap further comprises a hook-pile connector.

5. The trouser suspender of claim 1 wherein said first extender is an adjustable extender.

6. The trouser suspender of claim 5 wherein said adjustable extender comprises a buckle.

7. The trouser suspender of claim 5 wherein said adjustable extender comprises a hook-pile connector.

8. The trouser suspender of claim 1 wherein said first extender comprises a loop and said waist strap is received in said loop.

9. The trouser suspender of claim 1 further comprising an undergarment wherein said waist strap forms a waistband for said undergarment.

10. A method for securing trousers at a predetermined height below the waist comprising:

wearing a trouser suspender wherein said trouser suspender comprises a waist strap designed to extend around the waist of a wearer; and at least one extender attached to, and dependent from, said waist strap wherein said extender comprises a fastener attached to said extender opposite to said waist strap;

attaching said trouser suspender to said trousers with said fastener; and adjusting said extender such that said trousers are suspended below the waist.

11. The method for securing trousers of claim 10 wherein said trouser suspenders comprises two extenders.

12. The method for securing trousers of claim 10 wherein said extender is an adjustable extender.

13. The method for securing trousers of claim 10 wherein said trouser suspenders further comprises a modesty panel.

14. Trouser suspenders for securing trousers in a predetermined position below the waist wherein said trouser suspenders comprise:

an undergarment wherein said undergarment comprises a modesty panel and a waist band;

at least one extender attached to said undergarment; and a fastener attached to said extender wherein said fastener attaches to said trousers which are worn over said undergarment wherein said extender is attached to said undergarment at said waist band.

15. The trouser suspenders of claim 14 wherein said extender is an adjustable extender.

16. The trouser suspenders of claim 14 comprising two extenders.

17. The trouser suspenders of claim 16 wherein said two extenders are opposite to each other.

* * * * *